United States Patent [19]

Weber et al.

[11] Patent Number: 4,579,292

[45] Date of Patent: Apr. 1, 1986

[54] APPARATUS FOR UNWINDING A ROLL OF BLOCKING-PRONE WEB MATERIAL

[75] Inventors: Gerald M. Weber, Loveland; Godfrey Reiter, Cincinnati, both of Ohio

[73] Assignee: The Procter & Gamble Company, Cincinnati, Ohio

[21] Appl. No.: 735,284

[22] Filed: May 16, 1985

Related U.S. Application Data

[63] Continuation of Ser. No. 429,366, Sep. 30, 1982, abandoned.

[51] Int. Cl.[4] ..... B65H 16/10; B65H 23/185

[52] U.S. Cl. ..... 242/55; 242/75.1

[58] Field of Search ..... 242/55, 55.1, 55.2, 242/67.3 F, 75.1, 75.41

[56] References Cited

U.S. PATENT DOCUMENTS

| | | | |
|---|---|---|---|
| 2,223,445 | 12/1940 | Doble | 242/75.1 |
| 3,092,343 | 6/1963 | Beerli | 242/55 |
| 3,202,376 | 8/1965 | Dutro et al. | 242/75.1 |
| 3,423,040 | 1/1969 | Humphrey et al. | 242/67.3 R |
| 4,222,811 | 9/1980 | Enders | 156/406 |

*Primary Examiner*—Stuart S. Levy
*Assistant Examiner*—Joseph J. Hail, III
*Attorney, Agent, or Firm*—Thomas J. Slone; Fredrick H. Braun; Richard C. Witte

[57] ABSTRACT

An apparatus for unwinding a roll of web material which is prone to blocking: for example, an elastomeric film which, while rolled, is prone to having the convolutions of the roll stick together. The apparatus induces a sufficiently high rate of strain in a short span adjacent the roll to effect continuously peeling the outermost convolution from the roll. Additionally, the apparatus is of such a geometry that, in the event blocking precipitates circumferential shifting of the point of web separation from the roll, the stripping angle is increased. This, in turn, increases the effectiveness of the rate of strain induced peeling force on the web whereby more positive peeling occurs.

4 Claims, 3 Drawing Figures

APPARATUS FOR UNWINDING A ROLL OF BLOCKING-PRONE WEB MATERIAL

This is a continuation of application Ser. No. 429,366 filed on Sept. 30, 1982 now abandoned.

TECHNICAL FIELD

This invention pertains to an apparatus for unwinding rolls of web material, and forwarding unwound web to, for example, downstream converting apparatus such as converting apparatus for making disposable diapers. More specifically, this invention pertains to unwinding web material which is prone to blocking: i.e., prone to having the convolutions autogeniously stick together while rolled so that unwinding is impaired. Thermoplastic elastomeric webs, and tire ply webs are examples of blocking-prone materials.

BACKGROUND ART

Unwinding of blocking-prone web materials has been addressed to some extent in prior patents. For example, U.S. Pat. No. 4,222,811 which issued Sept. 16, 1980 to George E. Enders refers to rolls of belt or breaker components which have been wound with an anti-blocking liner web so that each convolution of blocking-prone material is disposed intermediate adjacent convolutions of liner material. Another approach to ameliorating blocking problems is disclosed in U.S. Pat. No. 3,423,040 which issued Jan. 21, 1969 to L. K. Humphrey et al and which is titled Apparatus For Dusting Of Surfaces. This apparatus applies an anti-blocking powder to the surfaces of a blocking-prone web as it is being wound into a roll.

While liners and dusting have been somewhat effective with respect to obviating or ameliorating problems associated with unwinding rolls of blocking-prone web materials, the present invention provides highly effective unwinding of blocking-prone web materials without requiring such liners or dusting and the problems incident thereto: for example, the need to rewind such liners and/or the need to remove dusting powder and the like from the unwound web prior to further processing of the web.

DISCLOSURE OF THE INVENTION

In accordance with one aspect of the present invention, an improved apparatus is provided for unwinding rolls of blocking-prone web materials. The apparatus comprises means for rotating a roll of such a web at a predetermined velocity, and means for forwarding unwound web from said apparatus in timed relation with downstream apparatus. The improvement comprises means for imparting a sufficiently great rate of strain in a span of the web immediately adjacent the roll of web to continuously peel the outer convolution from the roll of web. Means may be further provided to vitiate the induced strain in the web before the web passes the forwarding means. The means for inducing the rate of strain may comprise an idler roller which is biased against the outermost convolution of the roll of web; and a power rotated stripper roller disposed adjacent the nip between the idler roller and the roll of web. The unwound web is serpentinely looped between the rollers and about a circumferential portion of the stripper roller, and the stripper roller is driven at a sufficient peripheral velocity to induce a sufficient rate of strain in the unwound web to effect continuous peeling of the outermost convolution from the roll of web adjacent the driven stripper roller. Additionally, the geometry of the apparatus is such that any downstream circumferential shifting of the point-of-peeling of the web increases the stripping angle whereby a more effective peeling force is induced in the web. An alternate embodiment of the invention includes means associated with the stripper roller for defining a positive-feed web forwarding nip through which said web is looped and whereby said rate of strain is positively induced as opposed to relying on frictional engagement of the web with a circumferential portion of the surface of the stripper roller.

BRIEF DESCRIPTION OF THE DRAWINGS

While the specification concludes with claims particularly pointing out and distinctly claiming the subject matter regarded as forming the present invention, it is believed the invention will be better understood from the following descriptions taken in conjunction with the accompanying drawings in which:

DETAILED DESCRIPTION OF THE INVENTION

Figure 1:
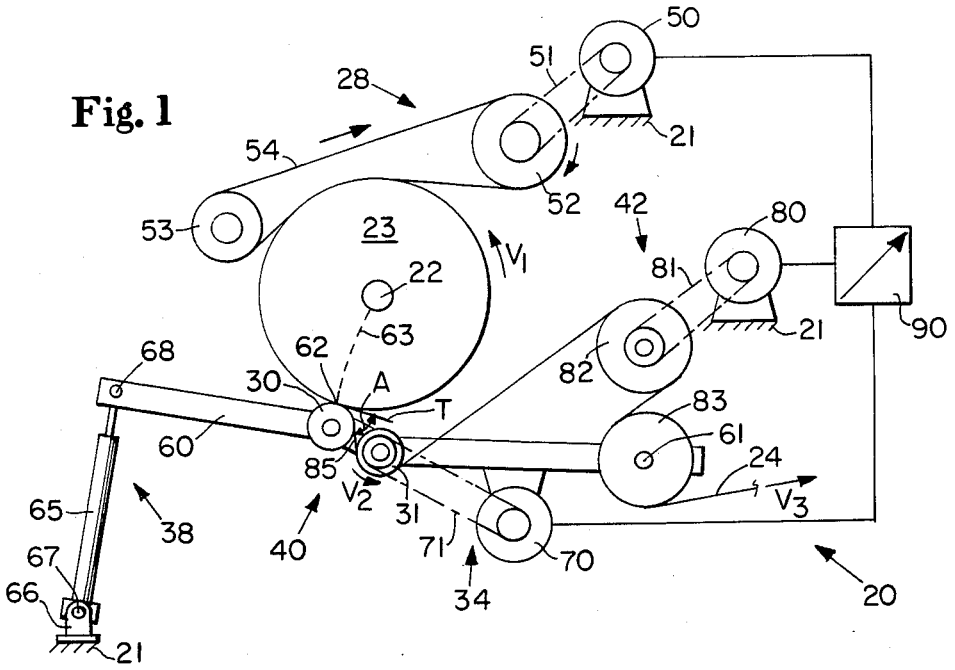
FIG. 1 is a fragmentary, somewhat schematic side elevational view of an apparatus for unwinding and forwarding web from a roll thereof, and which apparatus is an embodiment of the present invention.

An exemplary web unwind apparatus 20 which embodies the present invention is, albeit somewhat schematic and fragmentary, shown in FIG. 1 to include a frame 21, a freely rotatable shaft 22 on which a roll 23 of web 24 is mounted, means 28 for peripherally driving or rotating roll 23 on shaft 22 at a predetermined but controllable peripheral velocity $V_1$, a freely rotatable idler roller 30, a stripper roller 31, means 34 for rotating the stripper roller 31 at a predetermined but controllable velocity $V_2$, means 38 for continuously biasing the idler roller 30 against the outermost convolution 39 of roll 23, means 40 for maintaining a relatively fixed geometric relationship among idler roller 30, stripper roller 31, and the adjacent perimetric portion of roll 23 as web 24 is progressively unwound from roll 23, and means 24 for forwarding web 24 from apparatus 20 at a predetermined but controllable velocity $V_3$. Hereinafter, means 28, 34, 38, 40 and 42 are referred to as roll drive means 28, stripper roller drive means 34, idler roller biasing means 38, fixed geometry means 40, and web forwarding means 42, respectively.

Briefly, apparatus 20, FIG. 1, is used to unwind and forward web which is subject to blocking: for example, a thermoplastic elastomeric tape. Unwound web 24 is serpentinely looped from its point of separation from roll 23 so that it passes about and between idler roller 30, stripper roller 31, and the rollers of web forwarding means 42 as indicated in FIG. 1. In operation, $V_1$ is controlled at slightly less than $V_3$ to provide sufficient draw within apparatus 20 for positive control of web 24. Concomitantly, stripper roller 31 is normally rotated at a peripheral velocity $V_2$ which is sufficiently greater than $V_1$ to induce a great enough rate of strain in the length of web 24 intermediate roll 23 and stripper roller 31 to cause the outermost convolution of roll 23 to separate from roll 23 at the nip between roll 23 and the idler roller 30. Thus, the point of separation of web 24 from roll 23 is nominally the point of contact of idler roller 30 on roll 23; and, if the web is blocked, separation is in fact effected by peeling. Such a high rate of strain is induced by virtue of the short length of web involved, and the velocity differential between $V_2$ and $V_1$. Preferably, idler roller 30 has a surface which provides a low coefficient of friction with web 24, and stripper roller 31 has a surface which provides a high coefficient of friction with web 24. Such coefficients insure that stripper roller 31 will induce the desired rate of strain in the web which is in circumferential contact with idler roller 30 as well as in the free span 85. The purpose of the high rate of strain is to normally effect continuous peeling of the outermost convolution 39 of roller 23 at the nip between roll 23 and idler roller 30. After peeling has been effected, it is desirable to remove the induced strain. This is effected in the span of web intermediate stripper roller 31 and web forwarding means 42 and occurs due to the velocity differential between $V_2$ and $V_3$.

Means 28, FIG. 1, for peripherally driving roll 23 comprises a motor 50, a power transfer belt 51, a driver belt drum 52, an idler belt drum 53, and a drive belt 54. The power transfer belt 51 transfers power from the motor to rotate the driven belt drum 52. Drums 52 and 53 are rotatably mounted on a gravitationally movable carrier, not shown. Drive belt 54 is loosely looped about drums 52 and 53, and a circumferential portion of roll 23. Gravity, acting on the drum carrier, the drums, and the belt precipitates belt tension so that the belt 54 is driven by frictional engagement with the driven drum 52, and the roll 23 is rotated by belt 54. This is, however, not intended to limit the present invention to such gravity dependent drives, it being believed that alternate drives are well within the ordinary skill of practitioners in this field of art: for example, air cylinder loaded or spring loaded drive mechanisms.

Idler roller 30, FIG. 1, and stripper roller 31 are freely rotatably mounted on a carrier 60 which is pivoted on shaft 61. The length of carrier 60 between the center of rotation of idler roller 30 and shaft 61 is equal to the center-to-center distance between shaft 22 and shaft 61. Thus, as the carrier 60 is pivoted to maintain contact between the idler roller 30 and roll 23 as roll 23 is depleted, the point of contact 62 follows the arcuate dotted line 63 towards the center of shaft 22. Line 63 is designated the locus of the point-of-contact 62. This maintains a substantially fixed geometry among the idler roller 30, the stripper roller 31, and the adjacent peripheral portion of roll 23 as roll 23 is depleted. Accordingly, this portion of the apparatus is corporately designated and referred to as fixed geometry means 40.

Idler roll biasing means 38 acts to bias the idler roller 30 against roll 23 as roll 23 is depleted. As shown in FIG. 1, biasing means 38 comprises an actuator 65 which is pivotally secured to a clevis block 66 by wrist pin 67, and to the distal end of carrier 60 by wrist pin 68.

Means 34 for driving stripper roller 31 comprises a motor 70 which is mounted on carrier 60. Power is transmitted from motor 70 by a power transfer belt 71 to rotate stripper roller 31.

Means 42, FIG. 1, for forwarding web 24 from apparatus 20 comprises motor 80, belt 81, and drums 82 and 83. Drum 82 is driven by motor 80 through belt 81. In use, the web 24 is S-wrapped about and between drums 82 and 83 to provide sufficient frictional engagement with web 24 to substantially isolate the tension in the web that is within apparatus 20 from the tension in the web downstream from apparatus 20: i.e., downstream from drum 83.

In use, web 24 is serpentinely looped from roll 23, about idler roller 30, stripper roller 31, drums 82 and 83, and thence to some ancillary downstream apparatus (not shown) such as a disposable diaper converting line. The angle between the tangent T to roll 23, and the span 85 of web 24 between rollers 30 and 31 is designated the stripping angle A. The speeds of motors 50, 70, and 80 are preferably controlled through the use of controller 90 so that $V_3$ matches the demand speed of the downstream apparatus; so that $V_1$ is substantially equal to $V_3$ but sufficiently different to provide sufficient tension in web 24 for control thereof; and so that $V_2$ is substantially greater than $V_1$. In this respect, the $V_2-V_1$ speed differential acts to impart a high rate of strain on the short length of unwound web 24 upstream from stripper roller 31: i.e., span 85 plus the length wrapped about idler roller 30. The induced rate of strain is inversely related to the length and directly related to the $V_2-V_1$ velocity differential. Accordingly, these factors are interdependently set to normally provide a sufficiently high rate of strain to effect continuous peeling of nominally blocked web from roll 23 at the nip between roll 23 and idler roller 31 as stated hereinbefore. By way of example and not of limitation, a $V_2/V_1$ ratio of about 2:1 has been effective in an exemplary embodiment of the present invention to unwind a thermoplastic elastomeric ribbon in the $V_1$ speed range of from about two hundred to about four hundred feet per minute (about 61 to about 122 meters per minute).

While apparatus 20 has been described above as having independent drive motors for unwind means 28, stripper roller 31, and drum 82, they of course could be mechanically driven by a common source through the addition of gear boxes, speed changers, and the like.

Figure 2:
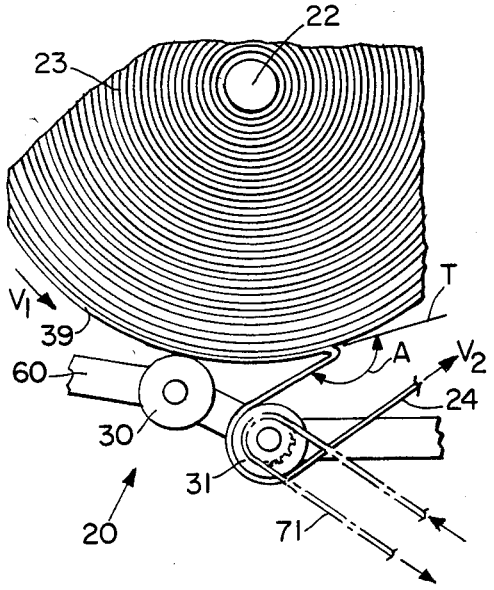
FIG. 2 is an enlarged scale, side elevational view of a fragmentary portion of the apparatus shown in FIG. 1, and in which view the point of separation of the web from the roll has circumferentially shifted in the direction of rotation from its normal, FIG. 1 disposition.

FIG. 2 is an enlarged scale, fragmentary side elevational view of the portion of apparatus 20, FIG. 1, which includes roll 23 of web 24 on shaft 22, idler roller 30, stripper roller 31, a fragment of carrier 60, and belt 71. This shows a web geometry which may be induced by greater than nominal blocking which was described above. In the event the rate of strain induced in the web between roll 23 and the stripper roller 31 is not sufficient to effect peeling at the nip between roll 23 and idler roller 30, the point-of-separation (i.e., the point-of-peeling) will be circumferentially shifted downstream as shown in FIG. 2. This circumferential shifting of the point-of-separation concomitantly increases the stripping angle A as a direct function of the degree of circumferential shifting. This effects more effective application of the peeling force induced in the web by the rate-of-strain and/or the strain induced in the web by the high peripheral velocity $V_2$ of stripper roller 31. Alternatively, means not shown could be provided for proportionally controlling the peripheral velocity of stripper roller 31 as a function of the degree of circumferential shifting of the point-of-separation to obviate excessive such shifting.

Figure 3:
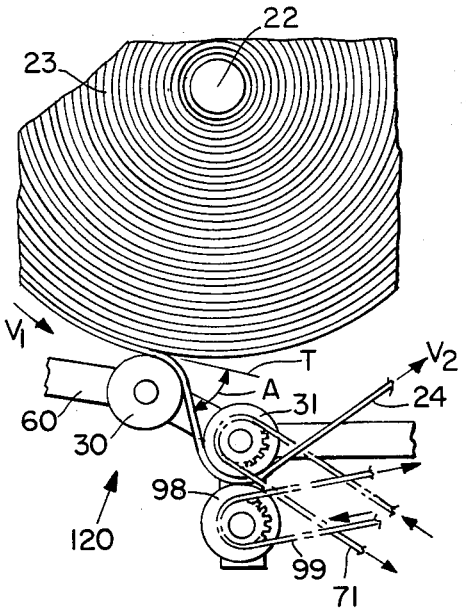
FIG. 3 is an enlarged scale, side elevational view of a fragmentary portion of an alternate apparatus embodiment of the present invention wherein a web drive nip is disposed adjacent the roll of web to be unwound.

FIG. 3 is a fragmentary portion of an alternate web unwinder 120 which is different from web unwinder 20 only to the extent of providing a driven, biased nip between stripper roller 31 and another driven roller 98.

Roller 98 is driven by belt 99 so that it has a peripheral velocity equal to that of stripper roller 31: i.e., $V_2$. This constitutes means for positively imparting velocity $V_2$ to the web 24 as compared to the frictional engagement of web 24 with the surface of stripper roller 31 as described above.

While particular embodiments of the present invention have been illustrated and described, it would be obvious to those skilled in the art that various other changes and modifications can be made without departing from the spirit and scope of the invention. It is intended to cover in the appended claims all such changes and modifications that are within the scope of this invention.

What is claimed is:

1. The improved unwind apparatus for unwinding rolls of blocking-prone elastomeric web which apparatus includes means other than pulling on an unwound length of said web for rotating a parent roll of said web at a predetermined velocity and means for forwarding unwound said web from said apparatus, said improvement comprising differential velocity means for imparting a sufficiently great rate of strain in a span of unwound said web immediately adjacent said parent roll to continuously peel the outer convolution from said roll of web, and means for substantially vitiating the strain induced in said web by said differential velocity means before said unwound web passes said forwarding means, said differential velocity means for imparting said rate of strain comprising:

a freely rotatably mounted idler roller;

means for continuously biasing said idler roller against the outermost convolution of said roll of web as said roll is unwound;

a rotatable stripper roller;

means for maintaining a substantially fixed geometry among said idler roller, said stripper roller and an adjacent spaced portion of the perimeter of said roll of web as said roll is unwound, said geometry providing closely spaced proximity between said idler roller and said stripper roller, and between said stripper roller and said adjacent portion of the perimeter of said roll of web so that said unwinding web may be serpentinely looped between and about said rollers and then through said means for forwarding; and means for rotating said stripper roller at a sufficiently greater peripheral velocity than said predetermined velocity of said parent roll to induce said sufficiently great rate of strain in said web to cause said web to be peeled from said roll of web adjacent said rollers.

2. The improved unwind apparatus of claim 1 further comprising means associated with said stripper roller for defining a positive-feed web forwarding nip.

3. The improved unwind apparatus of claim 1 or 2 wherein said stripper roller is so disposed that said apparatus comprises means for precipitating a progressively increased stripping angle upon progressively greater circumferential downstream shifting of the point of peeling of said web from said parent roll due to blocking that a more positive peeling force is induced in said web to peel said outermost convolution from said roll.

4. The improved unwind apparatus of claim 1 or 2 further comprising means for proportionally controlling said peripheral velocity of said stripper roller as a function of the degree of circumferential shifting of the point-of-peeling to obviate excessive circumferential shifting of the point-of-peeling of the web from the roll of web.

* * * * *